United States Patent [19]

Smith

[11] Patent Number: 4,921,593

[45] Date of Patent: May 1, 1990

[54] CATALYTIC DEWAXING PROCESS

[75] Inventor: Fritz A. Smith, New Hope, Pa.

[73] Assignee: Mobil Oil Corporation, New York, N.Y.

[21] Appl. No.: 87,198

[22] Filed: Aug. 20, 1987

[51] Int. Cl.[5] ..... C10G 47/16

[52] U.S. Cl. ..... 208/59; 208/111

[58] Field of Search ..... 208/57, 58, 59, 111, 208/120

[56] References Cited

U.S. PATENT DOCUMENTS

| | | | |
|---|---|---|---|
| 3,528,908 | 9/1970 | Bowles et al. | 208/57 |
| 3,723,296 | 3/1973 | Hahn | 208/59 X |
| 4,151,070 | 4/1979 | Allan et al. | 208/59 |
| 4,292,166 | 9/1981 | Gorring et al. | 208/59 |
| 4,597,854 | 7/1986 | Penick | 208/58 |
| 4,668,377 | 5/1987 | Chen et al. | 208/111 |

FOREIGN PATENT DOCUMENTS 0181066 6/1985 European Pat. Off. .

*Primary Examiner*—Glenn Caldarola

*Attorney, Agent, or Firm*—A. J. McKillop; C. J. Speciale; R. D. Stone

[57] ABSTRACT

A lubricant dewaxing process which is useful with difficult feeds, especially highly waxy feeds having paraffin contents in excess of 25 weight percent of feeds with high nitrogen levels, employs two-step dewaxing in which the first stage is carried out under relatively mild conditions to obtain extended catalyst cycle life between successive reactivations with a constant temperature for the duration of each dewaxing cycle. The second stage dewaxing is carried out under conditions which maintain the target pour point for the product with a progressively increasing temperature during each dewaxing cycle. More than one preliminary dewaxing stage may be provided in order to reduce severity in each stage with mild conditions and constant temperature being maintained in the preliminary steps. Using this process, extended catalyst cycle lives may be obtained with difficult feeds.

30 Claims, 1 Drawing Sheet

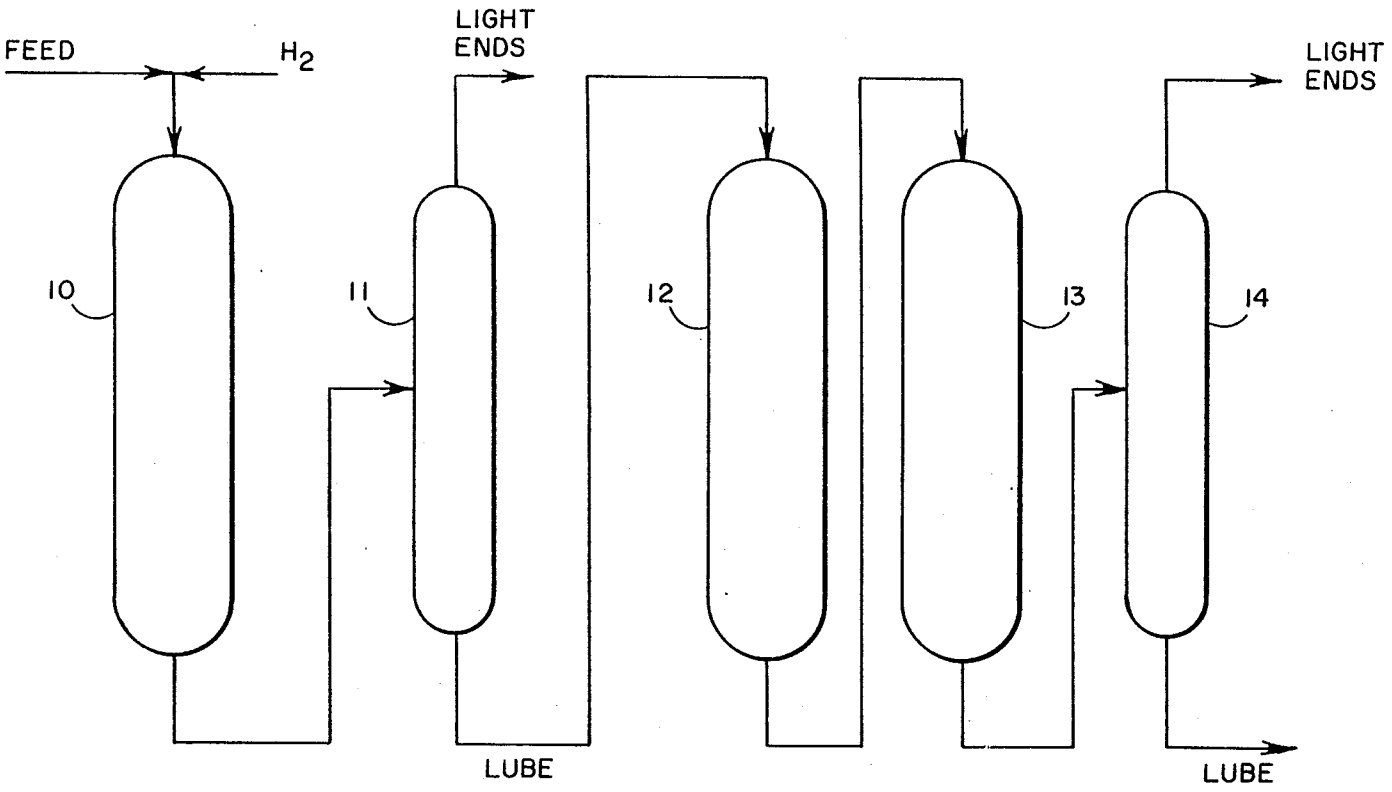
FEED
$H_2$
10
LIGHT ENDS
11
LUBE
12
13
14
LIGHT ENDS
LUBE

CATALYTIC DEWAXING PROCESS

Field of the Invention

The present invention relates to a catalytic dewaxing process for the production of low pour point lubricants.

BACKGROUND OF THE INVENTION

Mineral oil lubricants are derived from various crude oil stocks be a variety of refining processes. Generally, these refining processes are directed towards obtaining a lubricant base stock of suitable boiling point, viscosity, viscosity index (VI) and other characteristics. Generally, the base stock will be produced from the crude oil by distillation of the crude in atmospheric and vacuum distillation towers, followed by the separation of undesirable aromatic components and finally, by dewaxing and various finishing steps. Because aromatic components lead to high viscosity and extremely poor viscosity indices, the use of asphaltic type crudes is not preferred as the yield of acceptable lube stocks will be extremely low after the large quantities of aromatic components contained in such crudes have been separated out; paraffinic and naphthenic crude stocks will therefore be preferred but aromatic separation procedures will still be necessary in order to remove undesirable aromatic components. In the case of the lubricant distillate fractions, generally referred to as the neutrals, e.g. heavy neutral, light neutral, etc., the aromatics will be extracted by solvent extraction using a solvent such as furfural, N-methyl-2-pyrrolidone phenol or another material which is selective for the extraction of the aromatic components. If the lube stock is a residual lube stock, the asphaltenes will first be removed in a propane deasphalting step followed by solvent extraction of residual aromatics to produce a lube generally referred to as bright stock. In either case, however, a dewaxing step is normally necessary in order for the lubricant to have a satisfactorily low pour point and cloud point, so that it will not solidify or precipitate the less soluble paraffinic components under the influence of low temperatures.

A number of dewaxing processes are known in the petroleum refining industry and of these, solvent dewaxing with solvents such as methylethylketone (MEK), a mixture of MEK and toluene or liquid propane, has been the one which has achieved the widest use in the industry recently, however, proposals have been made for using catalytic dewaxing processes for the production of lubricating oil stocks and these processes possess a number of advantages over the conventional solvent dewaxing procedures. The catalytic dewaxing processes which have been proposed are generally similar to those which have been proposed for dewaxing the middle distillate fractions such as heating oils, jet fuels and kerosenes, of which a number have been disclosed in the literature, for example, in *Oil and Gas Journal*, Jan. 6, 1975, pp. 69–73 and U.S. Pat. Nos. RE 28,398, 3,956,102 and 4,100,056. Generally, these processes operate by selectively cracking the normal and slightly branched paraffins to produce lower molecular weight products which may then be removed by distillation from the higher boiling lube stock. The catalysts which have been proposed for this purpose have usually been zeolites which have a pore size which aduits the straight chain, waxy n-paraffins either alone or with only slightly branched chain paraffins but which exclude more highly branched materials and cycloaliphatics. Zeolites such as ZSM-5, ZSM-11, ZSM-12, ZSM-22, ZSM-23, ZSM-35, ZSM-38 and the synthetic ferrierites have been proposed for this purpose in dewaxing processes, as described in U.S. Pat. Nos. 3,700,585 (Re 28398); 3,894,938; 3,933,974; 4,176,050; 4,181,598; 4,222,855; 4,259,170; 4,229,282; 4,251,499; 4,343,692, and 4,247,388. A dewaxing process employing synthetic offretite is described in U.S. Pat. No. 4,259,174. Processes of this type have become commercially available as shown by the 1986 Refining Process Handbook, Hydrocarbon Processing, September 1986, which refers to the availability of the Mobil Lube Dewaxing Process (MLDW). Reference is made to these disclosures for a description of various catalytic dewaxing processes.

With the catalytic dewaxing processes of the type described above where the dewaxing is effected by a shape selective cracking of the waxy paraffinic components in the feed, extended catalyst cycle life is generally achieved without difficulty. However, in certain instances, problems may be encountered. For example, if the feed contains certain contaminents which effect the catalyst activity adversely, it may be desirable to subject the feed to an initial contaminent removal step by sorption over a zeolite in order to remove these contaminents. A process of this kind is described in U.S. Pat. Nos. 4,357,232 and a similar process for treating waxy fuel oils is described in 4,358,363. Typical aging curves for an intermediate pore size dewaxing catalyst are shown in 3,956,102 and 3,894,938 discloses that the cycle life of an intermediate pore size dewaxing catalyst may be longer with a virgin feed stream than it is with the safe feed stream after it has been hydrotreated. These and other problems are encountered most frequently with lube boiling feeds and this has tended to retard the spread of catalytic lube dewaxing processes. While there are probably hundreds of solvent dewaxing units operating, only seven catalytic lube dewaxers are believed so far to be operating (end 1986).

As stated above, catalytic dewaxing processes of this type operate by selective cracking of the waxy components in the feed. This implies that when the feed contains a relative high quantity of waxy components, the catalyst must be operated under conditions of relatively greater severity in order to achieve the target pour point. The increasing severity of operation, however, may lead to unacceptably short cycle times between successive catalyst reactivations because the high level of paraffin cracking which takes place under these conditions tends to deposit coke on the catalyst more rapidly than usual so that the catalyst quickly becomes deactivated and the operating temperature required to achieve the target pour point may increase excessively. It is, of course, desirable to avoid excessively high temperatures during any cycle since at these higher temperatures non-selective thermal and catalytic cracking becomes more favored. In certain cases, cycle life may become extremely short and may even become as short as a matter of a few hours which is quite unacceptable for commercial operation.

It would be possible to maintain catalyst activity by carrying out reactivation or regeneration at frequent intervals but although this may be acceptable for laboratory scale studies, it is quite unsatisfactory for commercial operation because it requires larger amounts of the relatively expensive dewaxing catalyst to be employed so that reactivation or regeneration can be carried out while dewaxing is proceeding with another load of catalyst.

SUMMARY OF THE INVENTION

It has now been found that highly waxy feeds with wax contents of at least 25 and usually at least 35 weight percent may satisfactorily be dewaxed in a catalytic dewaxing process by using a number of sequential dewaxing steps which are operated under different conditions. The process is operated with one more preliminary dewaxing stops in which the waxy feed is partly dewaxed under conditions of relatively mild severity to produce a partly dewaxed product which is then dewaxed to the target pour point in the final dewaxing step under conditions of relatively greater severity. In the preliminary reactor or reactors, no attempt is made to reduce the pour point to the target value but rather, the preliminary dewaxing is carried out at a substantially constant reactor inlet temperature during each dewaxing cycle i.e. between successive catalyst reactivations and this temperature is maintained at a value which gives an acceptable cycle duration. Thus, the preliminary dewaxing steps are carried out under conditions of relatively low and relatively constant reactor inlet temperature. The final dewaxing step is carried out under conditions which provide the required degree of dewaxing to achieve the target pour point. In the final dewaxing step reactor, no attempt is made to keep to a constant temperature during the dewaxing cycle but rather, the temperature is progressively increased in the conventional manner to achieve the target pour point as the catalyst becomes deactivated during the course of the dewaxing cycle. In Many cases, a single preliminary dewaxing step will be sufficient but with some highly waxy feeds it may be necessary to employ two or more preliminary dewaxing reactors, each of which is operated at a low temperature with relatively constant inlet temperature conditions during each dewaxing cycle.

This mode of operation is distinct from the normal catalytic dewaxing procedure where the dewaxing steps are conventionally operated so is to maintain constant yield or constant pour point. This conventional type of operation requires the inlet temperature and, therefore, the average catalyst bed temperature of the reactor to be progressively increased over a relatively wide range of inlet temperatures, typically greater than 40° F. (about 22° C.) during each dewaxing cycle as the catalyst becomes deactivated by coke deposition and contamination from heteroatom containing impurities in the feed.

THE DRAWINGS

The single figure of the accompanying drawings is a schematic illustration of a dewaxing unit for two-stage catalyst dewaxing

DETAILED DESCRIPTION

The present dewaxing process is generally applicable to the production of low pour point products from hydrocarbon feeds. Generally, therefore, the feed will boil above the naphtha boiling range so that the initial boiling point will be at least about 330° F. (about 165° C.) or higher, e.g. 385° F.+(about 195° C.+). Thus, the present process may be used with distillates such as jet fuel, diesel fuel, heating oil and fuel oil to produce corresponding products of improved fluidity. It is, however, particularly useful for the production of low pour point lubricating products from lube boiling range hydrocarbon feeds. As is well known, lubricants generally have an initial boiling point of at least 650° F. (about 345° C.) in order to prevent excessive volatilisation during use. Because a certain degree of cracking to lower boiling products occurs during any catalytic dewaxing process, the feed will necessarily be comprised of components which boil about 650° F. or higher but the presence of components boiling below 650° F. is not to be excluded although it should be understood that these components will be removed during subsequent separation steps so that they do not form part of the final dewaxed lubricant. It is, however, desirable to separate such components prior to the initial dewaxing since they only serve to load up the reactor and prevent it being used effectively for the dewaxing of the high boiling range materials. Generally, the end point of a particular feed will be in the range of 750° F. (about 400° C.) to over about 1050° F. (about 565° C.) depending upon whether the feed is a distillate (neutral) feed or a deasphalted resid feed (bright stock). The end point of the feed is not in itself significant although the presence of large amounts of high boiling, unextracted residual type materials will generally be undesirable because they are generally rich in coke precursors which lead to shortened cycle life for the dewaxing catalyst.

By way of example, the present process may be used with neutral lube feeds ranging from light neutrals, e.g. from 100 SUS at 40° C. to 700 SUS at 40° C., to bright stock. Typical light to medium neutral stocks may have an IBP below 650° F. (about 345° C.) (ASTM D-2887) and the end point may be below 1000° F. (about 540° C.). Heavier neutrals will generally boil in the range 650° C.–1050° F. (about 345°–565° C., ASTM D-1160, 10 mm. Hg), typically from 750° to 1050° F. (about 400°–565° C., ASTM D-1160). Residual feeds usually boil above 750° F. (about 400° C.) and have a 50% point above 850° F. (about 455° C.) (ASTM D 1160-1, 1 mm. Hg).

The lube feeds which are treated in the present process are highly waxy feeds which contain at least 25 and usually at least 35 weight percent waxy components. The waxy components are n-paraffins and slightly branched chain paraffins, mainly mono methyl paraffins. The presence of such large quantities of waxy components implies that the large quantities of waxy components implies that the feeds will be generally waxy in nature and characterized by high pour points and in many cases may be solid at ambient temperatures. Feeds of this type are typically obtained from highly paraffinic crude courses such as the southeast Asian crudes.

After removal of the low boiling components in atmospheric and vacuum distillation towers, the remaining fractions may be used for lube production. The 650° F.+ distillates may be used for production of the distillate or neutral lubes and the vacuum tower residuum may be used after deasphalting for the production of bright stock lubes. Aromatics may be removed from the distillate (neutral) feeds by solvent extraction using solvents such as phenol, furfural, N-methyl-pyrrolidone or other materials which are selective for the removal of aromatics. The vacuum tower residuum may be deasphalted by conventional deasphalting techniques, preferably propane deasphalting. The deasphalted resid may then be subjected to aromatics extraction by a conventional solvent extraction process as with the neutral stocks or used as such. The solvent extraction steps may, however, be replaced by hydrotreating in order to effect aromatic saturation as well as to remove heteroatom contaminants such as nitrogen and sulfur. Hydrotreating for this purpose is generally carried out at high pressure in order to increase aromatic saturation as such as possible and in most cases, pressures of at least 1000 psig (7000 kPa) and more typically at least 2000 psig (14,000 kPa) e.g. 2500 psig (17,340 kPa) will be used. Temperatures for the hydrotreating will, however, be kept at a relative low level in order to favor the hydrogenation of the aromatics which is a strongly exothermic reaction favored by low temperature. The hydrogen:oil ratio will be selected according to the aromatics concentration in the feed and the desired degree of aromatics removal. It will generally be in excess of about 2000 SCF/bbl (356 n.1.1$^{-1}$), usually in excess of 4000 SCF/bbl (712 3 n.1.1.$^{-4}$) e g typically about 4500 SCF/bbl (800 n.1.1.$^{-1}$). Space velocities for the hydrotreating be typically be in the range 0.25 to 5 and more commonly from 0.5 to 1 LHSV (hour$^{-1}$). Conventional (hydrotreating catalysts will be found suitable, comprising a hydrogenation component or components on a solid, sorous carrier. The metal (hydrogenation) component is typically a metal of Groups VIA or VIIIA of the Periodic Table, usually nickel, cobalt, molybdenum, tungsten or vanadium although noble metals such as platinum and palladium may be used if the feed is of sufficiently low hetero atom content. The support is usually of low acidic activity in order to minimize the degree of cracking since the objective of the hydrotreating step is to is to convert aromatics to naphthenes and paraffins by saturation rather than by cracking to lower molecular weight components. However, a shall degree of acidic functionality is desired for hetero atom removal since this requires a limited degree of ring opening to be effective.

A typical example of a highly paraffinic feed which may treated by the present invention is a hydrotreated 650°-850° F. (nominal) vacuum gas oil obtained from a North Sea crude of the composition shown in Table 1 below:

TABLE 1

| HDT North Sea Feed | |
|---|---|
| Nominal boiling range, °C. | 345-455 (650-850) |
| API Gravity | 31.0 |
| H, wt. pct | 13.76 |
| S, wt. pct | 0.012 |
| N,ppmw | 34 |
| Pour point, °C. (°F.) | 32 (90) |
| KV at 100° C., cST | 4.139 |
| P/N/A wt. % | |
| Paraffins | 30 |
| Naphthenes | 42 |
| Aromatics | 28 |

A more highly paraffinic feed which is highly suitable for processing by the present procedure if the 650°-1000° F. (nominal) vacuum gas oil obtained for a Minas (Indonesian) crude oil, having the composition set out in Table 2 below.

TABLE 2

| Minas Gas Oil | |
|---|---|
| Nominal boiling range, °C., (°F.) | 345°-540° (650°-1000°) |
| API Gravity | 33.0 |
| Hydrogen, wt pct | 13.6 |
| Sulfur, wt pct | 0.07 |
| Nitrogen, ppmw | 320 |
| Basic Nitrogen, ppmw | 160 |
| CCR | 0.04 |
| Composition, wt pct | |

TABLE 2-continued

| Minas Gas Oil | |
|---|---|
| Paraffins | 60 |
| Naphthenes | 23 |
| Aromatics | 17 |
| Bromine No. | 0.8 |
| KV, 100° C., cSt | 4.18 |
| Pour Point, °C. (°F.) | 46 (115) |
| 95% TBP, °C. (°F.) | 510 (950) |

Upon hydrotreating the paraffinic content of this feed would increase as shown by Table 2 below which is the composition of a hydrotreated Minas VGO (hydrotreating over Ni-Mo/$Al_2O_3$ hydrotreating catalyst, 800 psig $H_2$, 710°-35° F., 1 LHSV, 712n.1.1.$^{-1}$ hydrogen: feed ratio).

TABLE 3

| HDT Minas Feed | |
|---|---|
| Nominal boiling range, °C. (°F.) | 345-510 (650-950) |
| API Gravity | 38.2 |
| H, wt. pct. | 14.65 |
| S, wt. pct. | 0.02 |
| N, ppmw | 16 |
| Pour Point, °C. (°F.) | 38 (100) |
| KV at 100° C., cSt | 3.324 |
| P/N/A wt. pct. | |
| Paraffins | 66 |
| Naphthenes | 20 |
| Aromatics | 14 |

Other feeds which may suitably be treated by the present process include the difficult kirkuk (Iraq) lube feeds such as the light (100, SUS) and medium (400 SUS) neutrals and the bright stock shown in Table 4 below.

TABLE 4

| Kirkuk Feedstocks | | | |
|---|---|---|---|
| | Lt. Neutral | Med. Neutral | Bright Stock |
| API | 33.8 | 31.1 | 26.9 |
| Specific Gravity | 0.8621 | 0.8702 | 0.8933 |
| Pour Point, °F. | 70 | 115 | >120 |
| Flash Point, °F. | 363 | 498 | 601 |
| KV @ 130° F., cs | 8.657 | 27.36 | N/A |
| KV @ 100° C., cs | 3.268 | 7.856 | 26.62 |
| KV @ 300° F., cs | 1.551 | 3.253 | 8.610 |
| SUS @ 100° F., (calc) | 77.9 | 245 | |
| SUS @ 210° F., (calc) | 37.3 | 52.6 | 131.2 |
| Sulfur, wt. % | 0.75 | 0.51 | 1.18 |
| Basic Nitrogen, ppm | 35 | 34 | 135 |
| Total Nitrogen, ppm | 46 | 27 | 151 |
| Bromine Number | 1.8 | 1.3 | 2.5 |
| Neut. No., MGKOH/G | 0.22 | 0.15 | 0.18 |
| Aniline Point, °F. | 206 | | |
| Hydrogen, wt. % | 13.89 | 14.02 | 13.37 |
| Oil Content, wt. % | 83.76 | 80.61 | 70.95 |
| RI @ 70° C. | 1.4530 | 1.45876 | 1.47318 |

| Distillation, °F. Method | D2887 | D1160 (10 mmHg) | D1160 (10 mmHg) | D1160 (1 mmHg) |
|---|---|---|---|---|
| IBP | 541 | 602 | 776 | 792 |
| 5 | 603 | 652 | 824 | 967 |
| 10 | 629 | 667 | 839 | 993 |
| 30 | 695 | 710 | 862 | 1047 |
| 50 | 740 | 745 | 885 | 1088 |
| 70 | 781 | 776 | 911 | (1106 @ 60%) |
| 90 | 825 | 811 | 954 | |
| 95 | 841 | 824 | 971 | |
| EP | 885 | 836 | 1011 | |

Following removal of the aromatics by solvent extraction or by hydrotreating, the feed is subjected to catalytic dewaxing in the characteristic dewaxing steps of the present invention. The catalytic dewaxing is carried out by contacting the feed under dewaxing conditions of elevated temperature and pressure with a catalyst which selectively removes the waxy components (n-paraffins and slightly branched chain paraffins, especially monomethyl paraffins) from the feed. Dewaxing is usually carried out in the presence of hydrogen. Removal of the waxy components may be by shape selective cracking as is the case when the dewaxing catalyst comprises an intermediate pore size zeolite such as, for example ZSM-5, ZSM-11, ZSM-22, ZSM-23 or a synthetic ferrierite such as ZSM-35 or ZSM-38 or by ismerization when the dewaxing catalyst comprises zeolite beta. The use of ZSM-5 for the dewaxing of oils by shape selective cracking is disclosed, for example, in U.S. Pat. No. RE28,398, 3,956,102, 3,894,938, 4,357,232, 4,599,162, 4,490,242, 4,437,976, 4,357,232, 4,358,363, 4,372,839, 4,283,271, 4,283,272, 4,292,166 and in various other materials including the Catalysis Reviews: Sci. Eng. 28, 185–264 (1986). The relationship between zeolite structural properties and the relationship of zeolite structure to shape selective catalytic dewaxing activities is discussed in J. Catalysis 86 24–31 (1984). Reference is made to these patents and other publications for details of such processes. The use of zeolite beta for catalytically dewaxing is disclosed in U.S. Pat. Nos. 4,499,220 and 4,501,926.

Catalyst aging is expected to be best when the dewaxing catalyst employ either a silica binder or, preferably, is a binder-free zeolite catalyst, as described in co-pending application Ser. No. 087,197 of Emerson Bowes entitled Catalytic Dewaxing Process Using Binder-Free Catalyst (Mobil Case 4319), filed concurrently. The use of the binder-free zeolite catalyst in the present process is described and claimed in co-pending application Ser. No. 087,199 of Emerson Bowes and be, entitled Catalytic Dewaxing Process Using Brnder-Free Zeolite (Mobil Case 4326), filed concurrently.

Regardless of whether the dewaxing is effected either by shape selective cracking as with the intermediate pore size zeolite such as ZSM-5 or by ismerization, possibly accompanied by some cracking as with zeolite beta, coke becomes deposited on the active catalyst sites during the dewaxing reactions and this progressively deactivates the catalyst. The greater the degree of wax removal required of the catalyst the quicker this coke deactivation will be and accordingly, the problem of coke deactivation is particularly severe with the highly waxy crudes such as those described above. The progressive deactivation of the catalyst is generally compensated for by a progressive increase in the temperature of the dewaxing operation as the dewaxing cycle proceeds. However, there is a definite limit to the extent to which the temperature can be raised without an increase in non-selective thermal and catalyst in cracking which reduces both the yield and quality, especially the oxidative stability of the lube product. Thus, at some point, the cycle required to be terminated and the catalyst treated to restore its dewaxing activity and selectivity, either by a reactivation treatment with hydrogen at elevated temperature or other conventional technique for restoring the dewaxing capabilities of the catalyst. Hydrogen treatment to activate the catalyst is useful between successive oxidative regenerations in which the coke deposits are burned off the catalyst in the presence of an oxygen containing gas. It is preferred to use the hydrogen reactivation technique as much as possible because oxidative regeneration tends to cause agglomeration of metal components (expecially noble metal components) on the dewaxing catalyst which reduces catalyst activity. Since oxidative regeneration effects a reactivation of the catalyst i.e. a reversal of the deactivation process which takes place during use, it is regarded as a "reactivation" for the purposes of this disclosure.

In the present process, the dewaxing is carried out in at least two reactors with different conditions prevailing in each reactor. A preliminary dewaxing is carried out in one or more reactors under relatively mild conditions so that coke deposition on the catalyst, is maintained at a low level. Generally, one preliminary dewaxing reactor will be sufficient but with extremely waxy feeds, it may be desirable to use two or more preliminary dewaxing reactors each of which is operated under relatively mild conditions so as to obtain an extended cycle life with the catalyst. No attempt is made with the preliminary dewaxing to achieve a given pour point but rather, the preliminary dewaxing is operated so as to obtain an extended cycle life and because the pour point of the product of the preliminary waxing step is of no moment, the temperature of the preliminary dewaxing is not raised as the catalyst becomes deactivated during the course of the cycle. Thus, the preliminary dewaxing step is carried out at substantially constant reactor inlet temperature during the dewaxing cycle between catalyst reactivations and is maintained at a relatively low level. Minor variations in the inlet temperature and hence, to the average bed temperature in the reactor, may take place and may be desirable, for example, to compensate for changes in feed composition or to make some compensate for catalyst aging. However, the important consideration is that the severity in the first reactor and the temperature should be maintained at a relatively low and substantially constant level during the dewaxing cycle. The inlet temperature may therefore be varied with a controlled and narrow range, for example, increasing not more than 40° F. (about 22° C.) or less, e.g. 25° F. (about 14° C.) during the cycle.

The exact temperature selected will depend upon the wax content of the feed, the target four point and the acceptable duration of each cycle. The temperature should be lower with the more highly waxy feeds e.g. with paraffin contents of at least 50 wt percent such as the hydrotreated Menas VGO described above. Generally the temperature of the first stage will not exceed about 400° C. and in most cases will be below 380° C. In a typical operation with a 650° F.+ feed containing about 50 percent paraffins, a temperature of 370° C. was found to give a cycle life in excess of one month which is regarded as satisfactory. At the same time, the pour point of the oil was reduced from 60° C. for the feed to 25° C. at a line out temperature of 370° C. with stable operation under these conditions indicating that cycle life could be extended even further. The temperature in the first stage will usually be from 625° from 725° F. with typical dewaxing catalysts and once a line out temperature has been achieved in each cycle, it will be maintained constant at that value during the cycle. Hydrogen pressures will be typical of those used to afford catalytic dewaxing: because the dewaxing does not require hydrogen for stoichiometric balance regardless of whether it proceeds by shape selective cracking or by isomerization, only low hydrogen pressures are needed, typically below 1000 psig (7000 kPa) and pressures below 500 psig (3550 kPa) are typical. Space velocities are typically between 0.25 and 5 LHSV (hour$^{-1}$ more commonly from 0.5 to 2 LHSV. Again, because hydrogen is not required for stoichiometric balance, hydrogen:oil ratios may be relatively low, typically below 4000 SCF/bbl (about 770 n.l.l.$^{-1}$) but normally in the range000 to 3000 SCF/bbl (about 180−535 nl.l.$^{-1}$).

The function of the preliminary dewaxing step or steps is to achieve a partial dewaxing under conditions of mild but constant severity and to obtain an extended cycle time for the catalyst used in this step or steps. This implies that the product from the preliminary dewaxing step, whether carried out in one or more reactors, will be only partly dewaxed and accordingly will not meet the target product pour point. A final dewaxing is therefore carried out to bring the pour point within specification limits and this step is carried out under conditions which achieve the requisite degree of dewaxing. However, because a preliminary degree of dewaxing has been carried out, extended cycle life for the catalyst in the secondary dewaxing step may be achieved even under the conditions of higher severity necessary to reduce the pour point to the desired level. Because the catalyst will be subject to deactivation by coke deposition it will be necessary to increase the temperature of the final dewaxing step as the cycle proceeds in order to maintain the product pour point within specification limits. Thus, the secondary dewaxing step is characterized by using carried out under conditions of progressively increasing temperature between catalyst reactivations. The inlet temperature to the final rector will generally be between 250° and 425° C. with start-of-cycle (SOC) temperature typically about 275° C. and end of cycle (EOC) temperature typically going up to 400° C., depending upon the degree of dewaxing effected in the preliminary dewaxing step and the target pour point.

In contrast to the substantially constant, low temperature regime of the preliminary dewaxing step, the temperature in the secondary dewaxing step is progressively raised to compensate for catalyst aging so that the dewaxed product conforms to pour point specifications. The inlet temperature to the secondary step will therefore be raised over a relatively wide range greater than that over which the inlet temperature to the first reactor is varied. Thurs, the inlet temperature to the secondary dewaxing reactor will be increased by at least 25° (about 14° C.) and typically more than 40° F. (about 22° C.). In most cases, a significantly greater increase will be necessary in the course of the cycle, for example, from 500° F. (about 260° C.) to about 670° F. (about 355° C.) i.e. a rise of 170° F. (about 95° C.). Increases of at least about 100° F. about 55° C.) and more commonly at least about 120° F. (about 67° C.) will be encountered at the inlet to the secondary dewaxing reactor(s).

Other conditions will be similar to those employed in the preliminary dewaxing steps as to hydrogen pressure, space velocity and hydrogen circulation rate.

Interstage separation of light ends may take place between the dewaxing stages and is desirable since it will not only contribute to removal of inorganic heteroatoms but also to avoid loading up the secondary reactors.

Following the secondary dewaxing step, the dewaxed product may be subject to hydrotreating in order to saturate olefins in the lube boiling range produced by cracking so as to stabilize the product and also to remove any residual color bodies and to saturate aromatics. The hydrotreating may be carried out under relatively mild conditions using relatively low temperature and hydrogen pressures. Temperatures below 300° C. and hydrogen pressures below 000 psig (7000 kPa) are generally suitable since at this point it is not desired to carry any extensive cracking neither is extensive aromatics saturation necessary. Space velocities from 0.25 to 5, more commonly from 0.5 to 2 LHSV our-$^{1}$). Because hydrogen consumption is relatively low, hydrogen circulation rates of 500 to 3000 SCF/bbl (about 90-535n.l.l.$^{-1}$) are generally suitable. The hydrotreating catalyst is generally chosen to have a relatively low acidity in view of the need to minimize cracking and because a significant degree of heteroatom removal has been accomplished at this stage, noble metal hydrogenation components may be employed such as platinum or palladium but base metals such as nickel, cobalt, tungsten, etc. or other metals from Groups VIA and VIIIA of the Periodic Table may also be used. The support may be a low acidity intermediate pore size zeolite such as ZSM-5 which has been steamed to a low acidity level (alpha value) or subjected to alkali metal exchange to obtain the requisite level of acidity. Alternatively, a zeolite of high silica:alumina ratio with low inherent acidity may be used or conventional hydrotreating catalyst support of the amorphous type such as alumina, silica or silica-aluminal again of low acidity may be employed.

EXAMPLE 1-3

These examples illustrate the use of a single stage dewaxing process for producing a lube product.

A waxy feed comprised a furfural a refined heavy neutral raffinate from a mainland Chinese crude source having the properties set out below in Table 5.

TABLE 5

| Heavy Neutral Raffinate | | |
|---|---|---|
| Sp. Gr | (15/4° C.) | 0.8618 |
| Color, ASTM | | L5.0 |
| Pour Point, °F. | (°C.) | 140 (60.0) |
| Flash Point,°F. | (°C.) | 532 (278) |
| K.V. | (cSt) | |
| at 100° C. | | 10.0 |
| at 150° C. | | 4.23 |
| Total N | (ppmw) | 160 |
| Basic N | (ppmw) | 140 |
| Sulfur | (ppmw) | 450 |
| Arsenic | (ppmw) | 0.10 |
| Hydrogen | (wt %) | 14.00 |
| Carbon | (wt %) | 85.98 |
| RCR | (wt %) | 0.17 |
| R.I. at 70° C. | | 1.4558 |
| Oil Content | (wt %) | 51.0 |
| Aniline Point | (°C.) | 126.4 |
| Distillation | (D-1160) | |
| IBP/5% | (°F.) | 731/874 |
| 10/20 | | 910/941 |
| 30/40 | | 967/981 |
| 50/60 | | 998/1019 |
| 70/80 | | 1034/1065 |

The feed was catalytically dewaxed over a ZSM-5 dewaxing catalyst nickel under three different sets of conditions as shown in Table 6 below:

TABLE 6

| | HN Dewaxing | | |
|---|---|---|---|
| Example No. | 1 | 2 | 3 |
| $H_2$ pressure, psig (kPa abs) | 400(2860) | 2000(13890) | 2000(13890) |
| LHSV, hr$^{-1}$ | 0.5 | 0.5 | 0.25 |
| $H_2$ circulation SCF/Bbl | 2500 | 5000 | 500 |

TABLE 6-continued

| Example No. | HN Dewaxing 1 | 2 | 3 |
|---|---|---|---|
| Av. each temp., °F. (°C.) | 625-675 (330-357) | 620-675 (327-357) | 580-660 (304-349) |

After dewaxing the product was hydrotreated (Cyanamid HDN-30, $NiMo/Al_2O_3$ catalyst, 268° C., 400 psig $H_2$,0.5 LHSV, 2500 SCF/bbl $H_2$:oil) to saturate olefins.

In each case, the temperature was raised from the lowest to the highest value shown as the catalyst aged in an attempt to obtain a dewaxed lube oil product with a pour point of 16° F. (−90° C.). In all cases, the catalyst aging rate was so rapid that the target pour point could not be met after only one day on stream. A pour point of 60° F. (15° C.) was attainable at the maximum temperature shown in the above Table for each case. The runs in Examples 1,2, and 3 were terminated after about 4,2, and 6 days on stream, respectively, as the target pour point could not be attained at acceptable reactor temperatures.

EXAMPLE 4

This Example illustrates dewaxing using a preliminary dewaxing under low serverity, constant temperature conditions coupled with a secondary dewaxing to target pour point.

The reactor configuration used is shown in the Figure. For simplicity and clarity the hydrogen circuit is not shown. The feed passes into the preliminary (first stage) reactor where it is partly dewaxed under conditions of substantially constant temperature during the dewaxing cycle. The partly dewaxed product is fractionated in interstage separator 11 and the higher boiling fraction passed to the secondary reactor 12 in Which it is dewaxed to target pour point with the reactor temperature being raised during the cycle to compensate for catalyst aging. The dewaxed product then passes to hydrotreater 13 to saturate lube boiling range olefins to stabilize the product. The hydrotreated, dewaxed product then passes to product separator 14 to remove products boiling below the lube boiling range. Cut points on separators 11 and 14 may be set as desired. Typically they will remove the naphtha fraction and light ends at least in separator 11 although heavier fractions may also be removed, e.g. the middle distillate portion below 600° F. (about 315° C.) or 650° F. (about 345° C.). However, because it is the olefins which lead to accelerated catalyst aging and these are predominantly in the 330° F. − (165° C.−) fraction, interstage removal of this fraction is generally satisfactory for adequate second-stage operation. Cut point on separator 14 will be set according to product specification, e.g. to remove 650° F.− (about 345° C.−) fractions from the lube product. For demonstration purposes only, it was set at 330° F. (165° C.) in the Example, although obviously different values would be appropriate in normal operation.

The feed was the same solvent-refined heavy neutral raffinate used in Example 1-3. It was subjected to dewaxing over the safe 1% NiZSM-5 dewaxing catalyst used in Examples 1-3 at 400 psig (2860 kPa abs.) $H_2$ pressure, 0.5 LHSV and a hydrogen:oil ratio g 2500 SCF/Bbl (445 $n.l.l.^{-1}$). Reactor inlet temperature was lined out at 370° C. Which produced a pour point of 2 P to 29° C. for the partly dewaxed product consistently from 6 to 53 days on stream. An analysis of the partly dewaxed 330° F.+(165° C.+) product is given below in Table 7.

TABLE 7

| Single Stage Dewaxed Product | | |
|---|---|---|
| Sp. Gr | (15/4° C.) | 0.8737 |
| Color, ASTM | | 4.5 |
| Pour Point, °F. | (°C.) | 79 (26.0) |
| Flash Point, °F. | (°C.) | 345 (174) |
| K.V. | (cSt) | |
| at 100° C. | | 9.96 |
| at 150° C. | | 4.03 |
| N | ppmw | 203 |
| Basic N | ppmw | 185 |
| S | ppmw | 440 |
| C | wt pct | 86.15 |
| H | wt pct | 13.67 |
| RCR | wt pct | 0.24 |
| R.I., 70° C. | | 1.4623 |
| Oil Content | wt pct | 76.3 |
| Aniline Point, °F. | (°C.) | 246 (119.0) |
| Distillation | (D-1160) | |
| IBP | (°F.) | 389 |
| 5% | | 665 |
| 10 | | 834 |
| 20 | | 903 |
| 30 | | 931 |
| 40 | | 952 |
| 50 | | 974 |
| 60 | | 993 |
| 70 | | 1011 |
| 80 | | 1029 |

The partly dewaxed 330° F.+ (165° C. +) product was fed to a secondary dewaxing stage at 400 psig (2860 kPa abs) $H_2$ pressure, 0.5 LHSV, 2500 SCF/Bbl (445 $n.l.l.^{-1}$) $H_2$:oil.

The reactor inlet temperature was raised from 290° C. (SOC) to 380° C. at eight days on stream and then maintained at this value until 11 days on stream (temperatures normalized to −9° C. product pour point by 1° C./1° C. pour), to for a normalized aging rate of 11° C./day. After passing through the second stage dewaxing reactor, the product was cascaded to a hydrotreater to saturate lube boiling range olefins (Cyanmid HDN-30, $NiMo/Al_2O_3$ catalyst, 268° C., 400 psig $H_2$,0.5 LHSV, 2500 SCF/Bbl $H_2$: oil). This did not effect the dewaxing results. After 7 days on stream the product pour point was 6° C. and after 11 days was 16° C., indicating a significant improvement in product pour point with a significant extension of the dewaxing cycle, as compared to single stage operation, Furthermore, since the first stage catalyst was still operating satisfactorily after a longer period, reactivation would be possible only on the second reactor, enabling some reactivation economies to be effected.

Analysis of the second stage 330° F.+ (165° C.+) product at 7 and 11 days is given below in Table 8.

TABLE 8

| | Dewaxed Lube Products | | |
|---|---|---|---|
| Sp. Gr | (15/4° C.) | 0.8765 | 0.8750 |
| Vis. @ 40° C. | (cST) | 70.1 | 70.1 |
| @ 100° C. | (cSt) | 9.53 | 9.66 |
| Pour Point, °F. | (°C.) | 43 (6.0) | 61 (16.0) |
| Cloud Point,°F. | (°C.) | 50 (10.0) | 64 (18.0) |
| Color, ASTM | | L2 | L2 |
| RCR | (wt %) | 0.19 | 0.19 |
| Aniline Point | (°C.) | 117.0 | 118.0 |
| R.I. at 70° C. | | 1.4640 | 1.4640 |
| Bromine No. | | 0.6 | 0.5 |
| Neut. No. | (mgKOH/g) | Less than 0.05 | Less than 0.5 |
| Flash Point, °F. | (°C.) | 180 (82) | 174 (79) |
| Hydrogen | (wt %) | 13.63 | 13.63 |
| Sulfur | (ppm) | 230 | 190 |

TABLE 8-continued

| | | Dewaxed Lube Products | |
|---|---|---|---|
| Nitrogen | (ppm) | 230 | 210 |
| Basic Nitrogen | (ppm) | 167 | 166 |
| Distillation | (D-1160) | | |
| IBP | (°F.) | 306 | 327 |
| 5/10 | | 705/798 | 723/826 |
| 20/30 | | 880/916 | 886/917 |
| 40/50 | | 936/958 | 939/960 |
| 60/70 | | 973/991 | 979/998 |
| 80/90 | | 1016/1048 | 1018/1052 |
| 95/FBP | | —/— | —/— |

We claim:

1. A process for catalytically dewaxing a waxy hydrocarbon lubricant feed having an initial boiling point of at least 650° F. and a wax content of at least 25 weight percent, which comprises:

(i) catalytically dewaxing the feed by contacting the feed in the presence of hydrogen with a dewaxing catalyst at an elevated temperature which is maintained at a substantially constant reactor inlet temperature value during a dewaxing cycle to produce a partly dewaxed product, (ii) further dewaxing the partly dewaxed product by contacting it in the presence of hydrogen with a dewaxing catalyst at an elevated temperature which is progressively increased during the dewaxing cycle to produce a dewaxed product having a predetermined pour point.

2. A process according to claim 1 in which the feed contains at least 35 weight percent waxy components.

3. A process according to claim 1 in which the feed contains at least 50 weight percent waxy components.

4. A process according to claim 1 in which the feed contains at least 100 ppmw basic nitrogen.

5. A process according to claim 1 in which the dewaxing catalyst in each of Steps (i) and (ii) comprises an intermediate pore size zeolite.

6. A process according to claim 1 in which the dewaxing catalyst in each of Steps (i) and (ii) comprises ZSM-5.

7. A process according to claim 1 in which the dewaxing catalyst comprises ZSM-23 or a synthetic ferrierite.

8. A process according to claim 7 in which the synthetic ferrierite is ZSM-35 or ZSM-38.

9. A process according to claim 5 in which the feed is hydrotreated prior to being dewaxed.

10. A process according to claim 5 in which the feed is hydrotreated after being dewaxed.

11. A process according to claim 1 in which the feed comprises a distillate lube feed.

12. A process according to claim 1 in which the feed comprises a deasphalted resid.

13. A process according to claim 1 in which the feed comprises a solvent-refined raffinate.

14. A process according to claim 1 in which the feed has an initial boiling point of at least 750° F.

15. A process according to claim 14 in which the feed has an initial boiling point of at least 75° F. and a 50% point of at least 850° F.

16. A process for catalytically dewaxing a waxy hydrocarbon lubricant feed having an initial boiling point of at least 650° F. and a wax content of at least 25 weight percent, which comprises:

(i) selectively cracking waxy components of the feed by contacting the feed in a preliminary dewaxing reactor with an intermediate pore size zeolite dewaxing catalyst in the presence of hydrogen under dewaxing conditions, at elevated reactor inlet temperature which is increased by no more than 40° F. during a dewaxing cycle between successive catalyst reactivations, to produce a partly dewaxed product, (ii) dewaxing the partly dewaxed product in a secondary dewaxing reactor to achieve a target pour point by contacting the partly dewaxed product with an intermediate pore size dewaxing catalyst in the presence of hydrogen under dewaxing conditions at an elevated reactor inlet temperature which is progressively increased during the dewaxing cycle at a rate to compensate for catalyst deactivation so as to maintain the target pour point, to produce a dewaxed product of low pour point.

17. A process according to claim 16 in which the inlet temperature to the preliminary dewaxing reactor is increased by no more than 25° F. during the dewaxing cycle.

18. A process according to claim 16 in which the inlet temperature to the secondary dewaxing reactor is increased by at least 40° F. during the dewaxing cycle.

19. A process according to claim 18 in which the inlet temperature to the secondary dewaxing reactor is increased by at least 100° F. during the dewaxing cycle.

20. A process according to claim 16 in which the feed contains at least 35 weight percent waxy components.

21. A process according to claim 16 in which the feed contains at least 50 weight percent waxy components.

22. A process according to claim 16 in which the feed contains at least 100 ppmw basic nitrogen.

23. A process according to claim 16 in which the dewaxing catalyst in each of Steps (i) and (ii) comprises ZSM-5.

24. A process according to claim 16 in which the dewaxing catalyst comprises ZSM-23 or a synthetic ferrierite.

25. A process according to claim 24 in which the synthetic ferrierite is ZSM-35 or ZSM-38.

26. A process according to claim 16 in which the feed comprises a distillate lube feed.

27. A process according to claim 16 in which the feed comprises a deasphalted resid.

28. A process according to claim 16 in which the feed comprises a solvent-refined raffinate.

29. A process according to claim 16 in which the feed has an initial boiling point of at least 750° F.

30. A process according to claim 16 in which the feed has an initial boiling point of at least 75° F. and a 50% point of at least 850° F.

* * * * *